US006718788B1

(12) United States Patent
Shuck

(10) Patent No.: US 6,718,788 B1
(45) Date of Patent: Apr. 13, 2004

(54) METHOD FOR PRODUCING A DRAIN PAN AND DRAIN PAN PRODUCED THEREBY

(75) Inventor: Ronald D. Shuck, Hattiesburg, MS (US)

(73) Assignee: Building Materials Investment Corporation, Wilmington, DE (US)

( * ) Notice: Subject to any disclaimer, the term of this patent is extended or adjusted under 35 U.S.C. 154(b) by 0 days.

(21) Appl. No.: 10/379,072

(22) Filed: Mar. 4, 2003

(51) Int. Cl.[7] ..... F25D 21/14; B65D 1/34
(52) U.S. Cl. ..... 62/291; 220/571
(58) Field of Search ..... 62/291, 285, 288; 220/571; 29/DIG. 3; 248/247, 300

(56) References Cited

U.S. PATENT DOCUMENTS 4,783,971 A 11/1988 Alba ..... 62/291
5,105,630 A 4/1992 Kim ..... 62/285
5,511,386 A 4/1996 Russ et al. ..... 62/285
6,360,911 B1 3/2002 Arnold ..... 220/571
6,363,736 B1 4/2002 Kunkel et al. ..... 62/291

*Primary Examiner*—Chen Wen Jiang
(74) *Attorney, Agent, or Firm*—William J. Davis; Imre Balogh

(57) ABSTRACT

Method for producing a galvanized steel drain pan of rectangular or square configuration for use in refrigerators, freezers, and air conditioners to collect condensate water, the method includes the steps of: cutting a blank galvanized steel plate to the desired size; folding sides portions of the blank to a degree of 60 to 90 to form side portions of the drain pan; corrugating the corners formed by the side portions; and installing a drain fitting along with a pipe to drain the condensate water from the drain pan. Also disclosed is the drain pan made by the method.

16 Claims, 5 Drawing Sheets

METHOD FOR PRODUCING A DRAIN PAN AND DRAIN PAN PRODUCED THEREBY

BACKGROUND OF THE INVENTION

1. Field of the Invention

The present invention relates to a method for producing a drain pan used in air conditioning systems and the drain pan produced thereby. More particularly, the invention relates to a method for producing a seamless metal drain pan used primarily with attic air conditioning units for collecting and draining condensates emanating from such units.

2. Reported Development

Various air conditioning systems are known and used in the prior art. Central air conditioning systems generally comprise a condensing unit, an evaporator coil, an air handler to circulate air throughout the building, and refrigerant lines connecting the condensing unit and the evaporator coil. A blower pulls the air into the system where it passes over the evaporator coil then is circulated into the building thereby reducing the temperature therein.

In addition to reducing the temperature in the building, the air conditioning system also removes moisture therefrom: when the temperature in the evaporator coil is reduced below the dew point of the air passing over it, the air conditioning system removes moisture from the air which condenses on the surface of the evaporator coil. The condensate is collected in a pan associated with the evaporator coil.

The drain pans of the prior art used in air conditioning systems are typically made of plastic by known techniques such as molding or extrusion. Illustrative examples are disclosed, for example in U.S. Pat. Nos. 5,105,630, 5,511, 386 and 6,360,911.

Drain pans are also used in refrigerators to collect condensates wherein the refrigerators contain refrigeration loops which include compressors, condensers, expansion valves and evaporators. As ice forms on the outside of the evaporator, it interferes with the thermal transfer of hear to the evaporator. In order to remove the ice, refrigerators typically have a periodic defrost cycle wherein an electric heating element is activated during an off cycle of the compressor. As a result, the ice melts from the compressor and flows through a drain hose to a drain pan.

Drain pans of the prior art used in refrigerator/freezer units are typically made of plastics such as disclosed for example in U.S. Pat. Nos. 4,783,971 and 6,363,736.

It is an object of the present invention to provide a drain pan to collect condensates emanating from refrigerator/freezer units and particularly form attic air conditioning units, wherein the drain pan is made of galvanized steel chromated and zinc coated for long-lasting use, stable to prevent tipping when removed from such units, and inexpensive to produce. Accordingly, the present invention relates to a method for producing a drain pan, and a drain pan produced by said method.

SUMMARY OF THE INVENTION

The foregoing object for collecting water formed by melting ice and/or condensation emanating from an air conditioning unit is accomplished by providing a drain pan associated with such units, wherein the drain pan is rectangular or square configuration and comprises a bottom portion, side walls, a back wall, a front wall, and a drain fitting in one of the side walls.

The method of producing the drain pan comprises the steps of:

- cutting a blank galvanized steel plate to rectangular or square configuration having a size slightly larger than the desired size of the drain pan;
- folding back the edges of the blank plate 180° to form a rim on each of the four sides of the blank;
- folding back the sides of the blank upward at a degree of about 60 to 90, and preferably about 75 degrees to form the sides of the drain pan;
- notching the four corners of the blank and pressing them into a corrugated configuration;
- punching a hole in one of the sides of the drain pan to accommodate a drain fitting therein; and
- installing a drain fitting in the hole.

DESCRIPTION OF THE PREFERRED EMBODIMENTS

Figure 1:
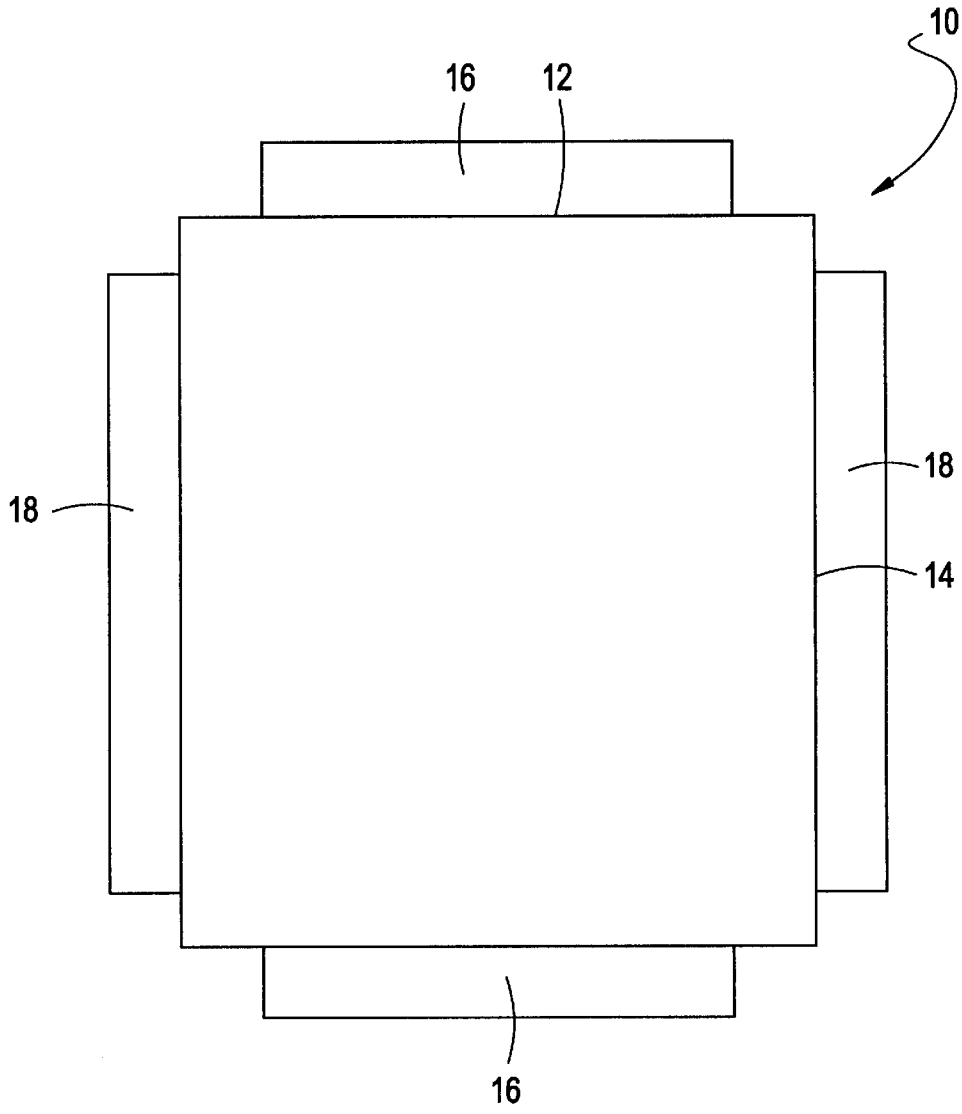
FIG. 1 is a top plan view of a galvanized metal plate cut to a generally rectangular configuration which illustrates the first step in producing a drain pan.

Referring to FIG. 1, there is shown a galvanized metal plate generally designated at 10 made of chromated, zinc coated steel, having a thickness of from about 1 mm to 3 mm. The galvanized steel plate is preferably ASTM A653 quality galvanized steel with G-30 to G-60 zinc coating having a Gauge of 26, 24 or 22. Galvanization is accomplished by spraying, immersion or electrolytic deposition if zinc on the steel substrate. As shown, the plate is generally of rectangular configuration having a width 12 and a length of 14 having the dimension of 12" to 36" width and 12" to 36" length. Preferably, the configuration of the plate is square having the dimensions of 24" width and 24" length.

In making the drain pan of the present invention, the process includes the following steps.

The galvanized plate 10 is cut to the desired blank size. The blank should include a 1.0" to 5.0" or more flat appendages 16 and 18 around the width 12 and length 14 of the plate 10 in order to allow folding back of the edges of the blank to form a hem or rim and side portions on each of the four sides thereof. About 5" to 6" of the four corners of the blank should be left without appendages to allow the formation of corrugated portions described in connection with FIG. 2.

Figure 2:
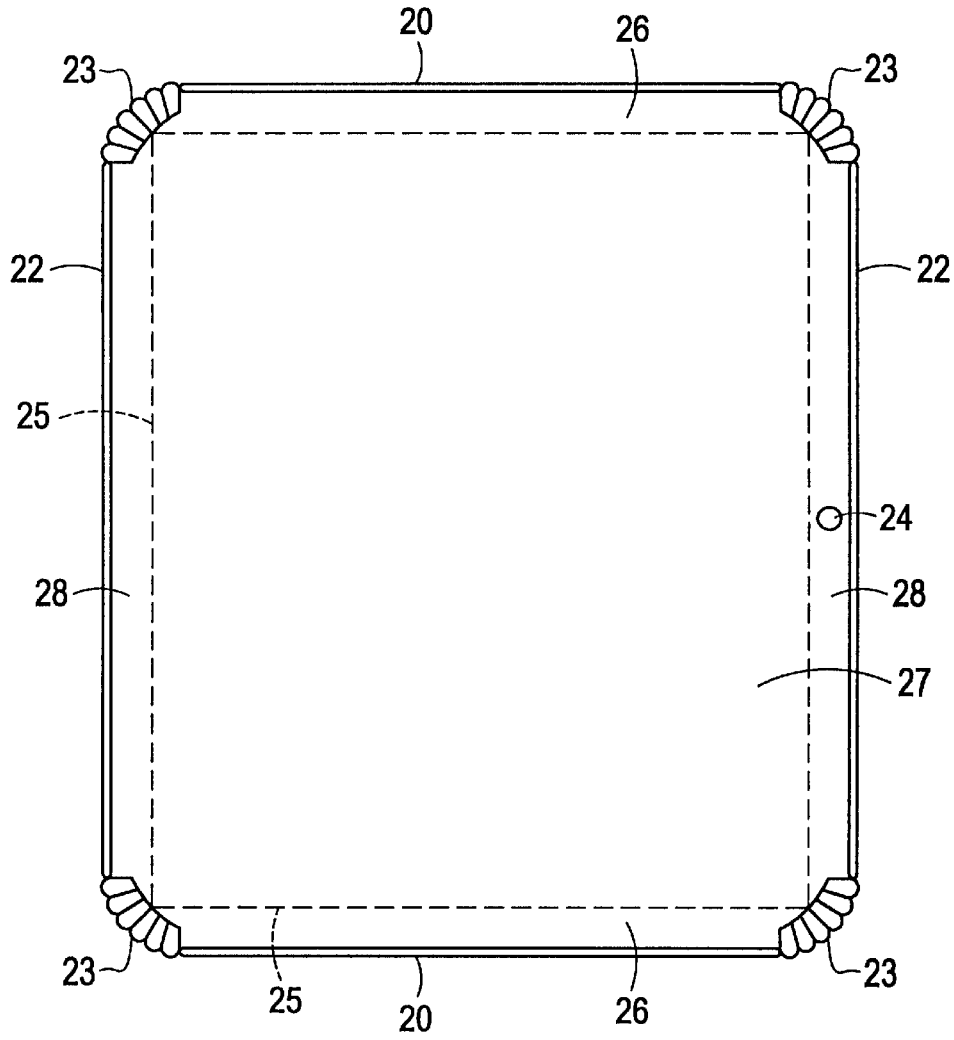
FIG. 2 is a top plan view of the galvanized metal plate illustrating the second step in producing the drain pan wherein: the four edges of the plate are folded back toward the inside of the plate forming a rim, the four corners of the plate are corrugated a hole adjacent to an edge of the plate is formed to accommodate a drain fitting, and staggered lines spaced and running parallel to the four edges of the plate are marked along which the plate will be folded generally vertically to form the drain pan.

FIG. 2 shows the second step in making the drain pan of the present invention in which about 1.0" to 5.0" of the flat appendages 16 and 18 are folded back 180 degrees towards the inside of the plate to form the hem or rim 20 and 22. The four corners 23 are notched and formed into corrugated or undulated configuration with a press. Then a hole 24 is punched adjacent to rim 22 of the plate to accommodate a drain fitting. A staggered line 25 is marked and spaced parallel to rims 20 and 22 along which sides 26 and 28 are bent upward at an angle of about 60° to 90°, and preferably about 75°. Sides 26 and 28 typically have a height of 1" to 5" or more, and preferably about 2" to 4".

Figure 3:
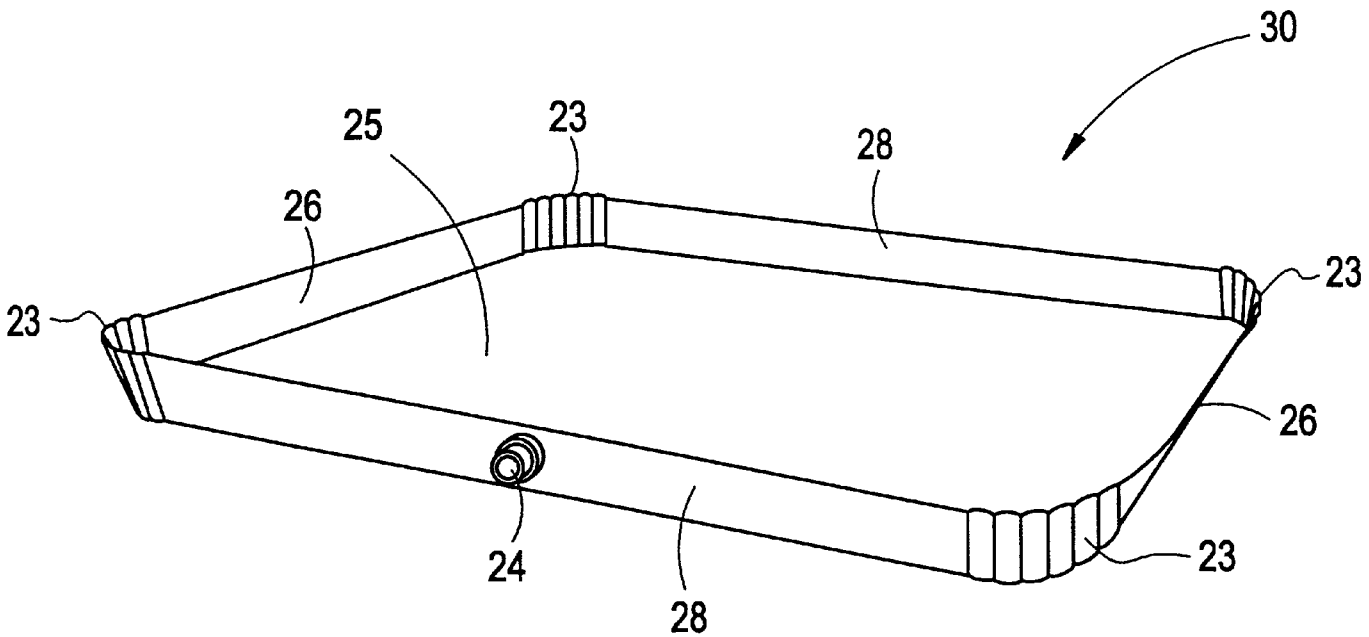
FIG. 3 is a perspective view of the finished drain pan in which the four sides of the plate are folded vertically projecting upward at an angle of about 60° to 90°, and preferably about 75°.

FIG. 3 shows a perspective view of the completed drain pan generally designated at 30. It is to be noted that the drain pan is seamless and cannot have leakage therefrom. As shown, the drain pan 30 comprises:

a bottom wall 27 having a width of from about 12" and a length of 30", and preferably about 20" width and a length of 24";

side walls 26;

front and back walls 28;

corrugated corners connecting side, front and back walls 23;

a hole in the front wall 24 for receiving a drain fitting; wherein said bottom, side, front and back walls and said corrugated corners are integral with each other without seams therebetween thereby producing a leak-proof drain pan for uses associated with air conditioning and freezer/refrigerator systems.

Figure 4:
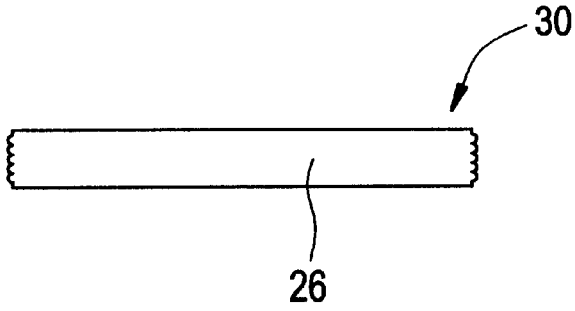
FIG. 4 is an end elevational view of the drain pan shown in FIG. 3, the other end elevational view being identical thereto.

FIG. 4 is an end elevational view of the drain pan 30 showing the shorter side wall 26, the other end elevational view being identical thereto.

Figure 5:
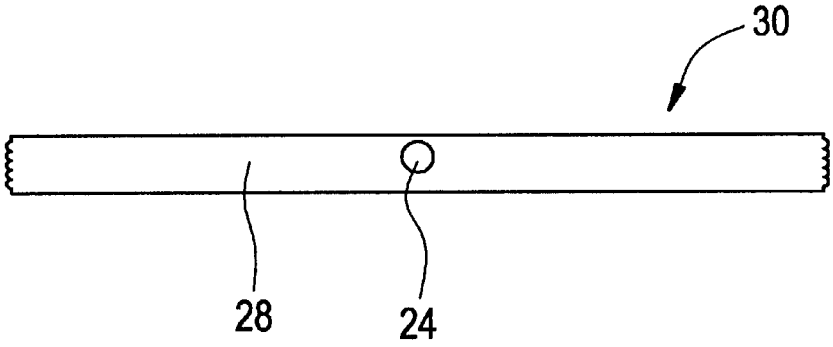
FIG. 5 is a side elevational view of the drain pan shown in FIG. 3.

FIG. 5 is a side elevational view of the drain pan 30 showing longer side wall 28 and hole 24 positioned in the side wall 28.

Figure 6:
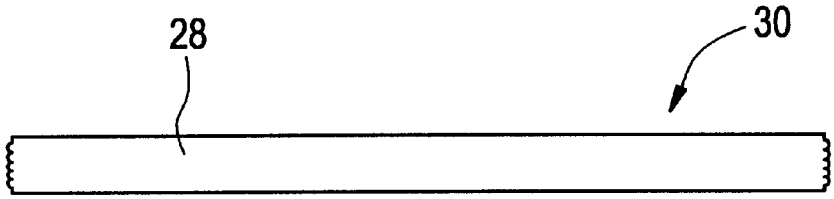
FIG. 6 is another side elevational view of the drain pan shown in FIG. 3.

FIG. 6 is another side elevational view thereof of the drain pan 30 showing side wall 28.

Figure 7:
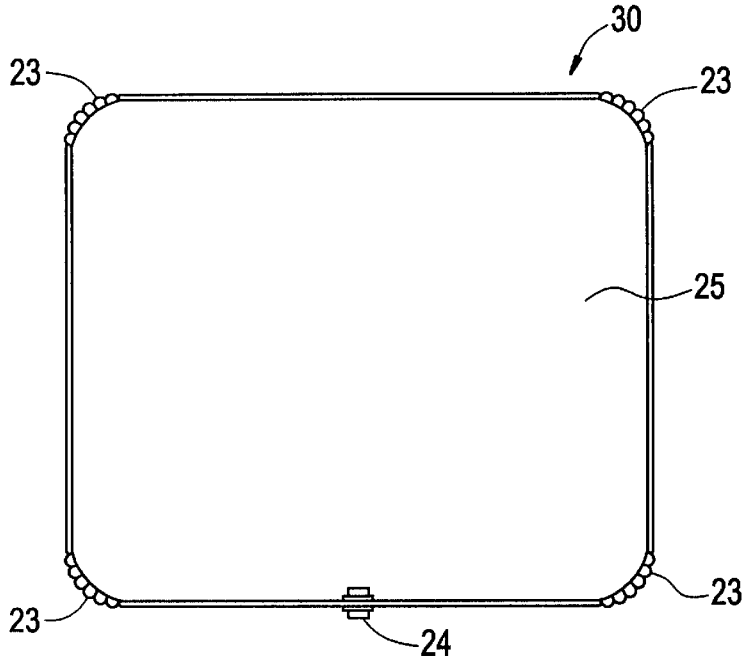
FIG. 7 is a top plan view of the drain pan shown in FIG. 3.

FIG. 7 is a top plan view of the drain pan 30, showing bottom wall 25, corrugated corners 23, and hole 24.

Figure 8:
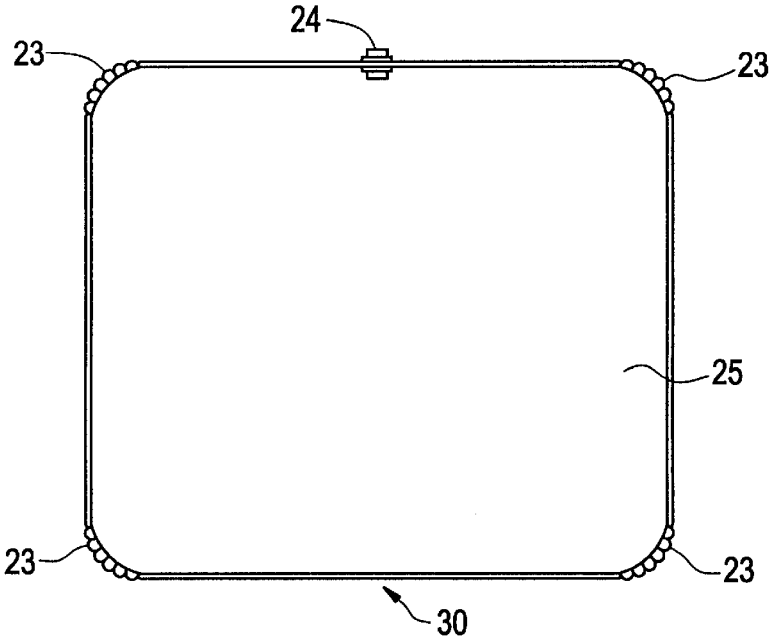
FIG. 8 is a bottom plan view of the drain pan shown in FIG. 3.

FIG. 8 is a bottom plan view of the drain pan 30, showing the bottom wall 25, corrugated corners 23, and hole 24.

Figure 9:
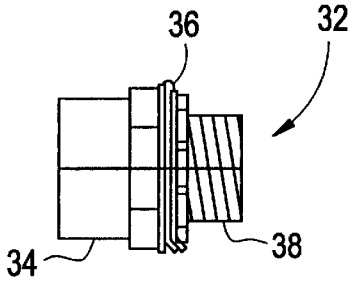
FIG. 9 is a side elevational view of a drain pan fitting.

FIG. 9 is a side elevational view of a drain pan fitting generally designated 32, showing male PVC adapter 34, rubber washers 36, and threaded galvanized nut 38. In use the drain fitting is inserted in hole 24 hermetically closing the drain pan 30. When installed in an air conditioner, freezer or refrigeration unit, a hose is attached to male adapter 34 for draining condensates from the drain pan 30.

The drain pans of the present invention nest inside one another for easy storage and shipment.

| PARTS LIST | |
|---|---|
| Galvanized metal plate, generally designated | 10 |
| Width of metal plate | 12 |
| Length of metal plate | 14 |
| Appendages of metal plate | 16, 18 |

-continued

| PARTS LIST | |
|---|---|
| Hem or rim of metal plate | 20, 22 |
| Corrugated corners of metal plate | 23 |
| Hole in metal plate | 24 |
| Staggered line marked on metal plate | 25 |
| Sides of metal plate to be bent | 26, 28 |
| Bottom wall of drain pan | 27 |
| Drain pan | 30 |
| Drain fitting, generally designated | 32 |
| Male adapter | 34 |
| Rubber washers | 36 |
| Threaded galvanized nut | 38 |

Having described the invention, it will be apparent to those skilled in the art that alterations and modifications may be made without departing from the spirit and scope of the invention limited only by the appended claims.

What is claimed is:

1. A method of producing a drain pan for use in refrigerators, freezers and air conditioners comprising the steps of:

cutting a blank galvanized steel plate to a rectangular or square configuration, said blank having a size slightly larger than the desired size of the drain pan, said blank having four side edges and four corners;

folding said side edges 180° to form a rim on said side edges;

folding side portions of the blank upward at a degree of about 60 to 90 to form the side portions of the drain pan;

notching said four corners of the blank and pressing them into corrugated configurations;

punching a hole in one of the side portions of the blank to accommodate a drain fitting therein; and installing said drain fitting in said hole to complete the production of said drain pan.

2. The method of claim 1 wherein said blank galvanized steel plate is produced by immersion of said steel plate into a zinc solution, spraying or electrolytical deposition of zinc onto said steel plate.

3. The method of claim 1 wherein said blank is of square configuration having a width of about 24" and a length of about 24".

4. The method of claim 1 wherein said side portion of said blank is folded upward to about 75 degrees.

5. The method of claim 1 wherein said drain fitting comprises a polyvinyl chloride adapter, rubber washers, and a galvanized nut.

6. The method of claim 1 wherein a pipe or tube is attached to said drain fitting to lead condensate water away from said drain pan.

7. A drain pan produced by the method of claim 1.

8. A method of producing a drain pan for use in refrigerators, freezers and air conditioners for collecting condensates comprising the steps of:

providing a blank galvanized steel plate having a thickness of from about 1 mm to about 3 mm;

cutting said blank into a generally rectangular or square configuration, defined by four side edges and four corners and having a width of from about 12" to about 36" and a length of from about 12" to 36";

folding about a 0.5" to 1.0" portion of side edges 180° towards the inside of said blank to form a rim thereon;

folding back side edges parallel to said rim and spaced about 1" to 5" therefrom at an angle of 60° to 90°, to form side portions of the drain pan;

notching said four corners of the blank and pressing them into corrugated configurations;

punching a hole in one of the side portions to accommodate a drain fitting therein; and installing said drain fitting in said hole to complete the production of said drain pan.

9. The method of claim 8 wherein said blank galvanized steel plate is produced by immersion of said steel plate into a zinc solution, spraying or electrolytical deposition of zinc onto said steel plate.

10. The method of claim 8 wherein said blank is of square configuration having a width of 24" and a length of 24".

11. The method of claim 8 wherein said side portion of said blank is folded upward to about 75 degrees.

12. The method of claim 8 wherein said side edges parallel to said rim are spaced about 2" to 4".

13. The method of claim 8 wherein said drain fitting comprises a polyvinyl chloride adapter, rubber washers, and a galvanized nut.

14. The method of claim 8 wherein a pipe or tube is attached to said drain fitting to lead condensate water away from said drain pan.

15. A drain pan produced by the method of claim 8.

16. A drain pan of galvanized steel having a thickness of about 1 mm to 3 mm for use in refrigerators, freezers and air conditioners to collect condensate water therein, said drain pan having a rectangular or square configuration comprising:

a bottom wall having a size of about 12" to 30";

side walls having a height of about 1" to 5" enclosing an angle of 60° to 90° with said bottom wall, said side walls terminating in rims;

corrugated corners connecting said side walls; and a drain fitting positioned into one of said side walls to receive a tube to drain condensate water away from said drain pan, wherein said bottom wall, side walls and corrugated corners are integral with each other having no seams therebetween.

* * * * *